US007626559B2

(12) United States Patent
Marcilliat et al.

(10) Patent No.: US 7,626,559 B2
(45) Date of Patent: Dec. 1, 2009

(54) THREE-PRONG CLIP AND METHODS OF INSTALLATION

(75) Inventors: Philip Marcilliat, Denver, CO (US); Morgan Kirby, Palmer Lake, CO (US); Jerome LaPalme, Parker, CO (US); Andrew David McAuley, Littleton, CO (US)

(73) Assignee: Echostar Technologies, L.L.C., Englewood, CO (US)

( * ) Notice: Subject to any disclaimer, the term of this patent is extended or adjusted under 35 U.S.C. 154(b) by 205 days.

(21) Appl. No.: 11/967,344

(22) Filed: Dec. 31, 2007

(65) Prior Publication Data

US 2009/0167629 A1 Jul. 2, 2009

(51) Int. Cl.
*H01Q 1/22* (2006.01)

(52) U.S. Cl. ..... 343/878; 24/350

(58) Field of Classification Search ..... 343/878; 24/350; 29/600

See application file for complete search history.

(56) References Cited

U.S. PATENT DOCUMENTS

| | | | | |
|---|---|---|---|---|
| 4,043,092 | A | 8/1977 | Paul et al. | |
| 5,090,097 | A | 2/1992 | Koester et al. | |
| 5,210,544 | A * | 5/1993 | Jones et al. | 343/840 |
| 5,647,748 | A | 7/1997 | Mills et al. | |
| 5,896,624 | A | 4/1999 | Horswell | |
| 6,037,913 | A * | 3/2000 | Johnson | 343/882 |
| 6,226,840 | B1 | 5/2001 | Lu | |
| 6,262,691 | B1 * | 7/2001 | Austin et al. | 343/890 |
| 6,295,036 | B1 * | 9/2001 | Mata et al. | 343/878 |
| 6,404,400 | B1 * | 6/2002 | Tulloch | 343/765 |
| 7,120,969 | B2 | 10/2006 | Carls | |
| 7,292,458 | B1 | 11/2007 | Chern et al. | |
| 7,439,930 | B2 * | 10/2008 | Bury | 343/878 |

* cited by examiner

*Primary Examiner*—Huedung Mancuso
(74) *Attorney, Agent, or Firm*—Max S. Gratton

(57) ABSTRACT

Various embodiments of a three-prong clip are described along with assemblies and methods of installation utilizing the three-prong clip. A three prong unitary clip has a central axis and a base and three separate prongs formed on opposing sides of the base. Each prong has a first portion extending from the base at a first angle towards the axis of the clip, a second portion extending from the first portion at a second angle away from the axis of the clip, and a retention tab formed between the first portion and the second portion. The prongs separate on the opposing sides of the base and each retention tab on each prong forms a clamping surface generally parallel to the axis of the clip on an element secured therebetween.

15 Claims, 4 Drawing Sheets

THREE-PRONG CLIP AND METHODS OF INSTALLATION

BACKGROUND

With the increasing popularity of satellite television, satellite antenna reflectors are becoming a common sight in neighborhoods. Satellite antenna reflectors are commonly mounted on rooftops of homes, and regardless of the satellite television provider, are generally similar in appearance and color. Reflector covers have been developed to allow individuals to customize the appearance of their satellite antenna reflectors. Reflector covers are typically made of plastic and molded to fit the contours of a satellite antenna reflector. These reflector covers often have a logo or other design printed on the displayable surface, such as the logo of a company or of a football team. Because satellite antenna reflectors are mounted outside and exposed to the elements, they are designed to withstand fierce winds of up to 155 MPH. However, reflector covers are attached to a satellite antenna reflector using doubled sided adhesive tape. Double sided adhesive tape is inadequate for withstanding high winds encountered in many locations where satellite antenna reflectors are installed. As a result, the satellite antenna reflectors may blow away when exposed to these high winds.

BRIEF DESCRIPTION OF THE DRAWINGS

The same number represents the same element or same type of element in all drawings.

DETAILED DESCRIPTION

The various embodiments described herein generally provide apparatus, systems and methods for securing two or more elements using a securing clip. More particularly, the various embodiments described herein provide a unitary clip with three-prongs formed on opposing sides of a base that clamps one or more elements therebetween. In short, the various embodiments described herein provide a three-prong clip, and assemblies and methods of installation incorporating the three-prong clip.

In at least one embodiment, the three-prong clip is utilized to secure a reflector cover to a satellite antenna reflector. The three-prongs are configured to separate towards the opposing sides of the base to receive the satellite antenna reflector and the reflector cover between the opposing prongs. Each of the three-prongs may include a retention tab that engages a surface of the reflector cover or the satellite antenna reflector to form a clamping surface and secure the reflector cover to the satellite antenna reflector.

Figure 1:
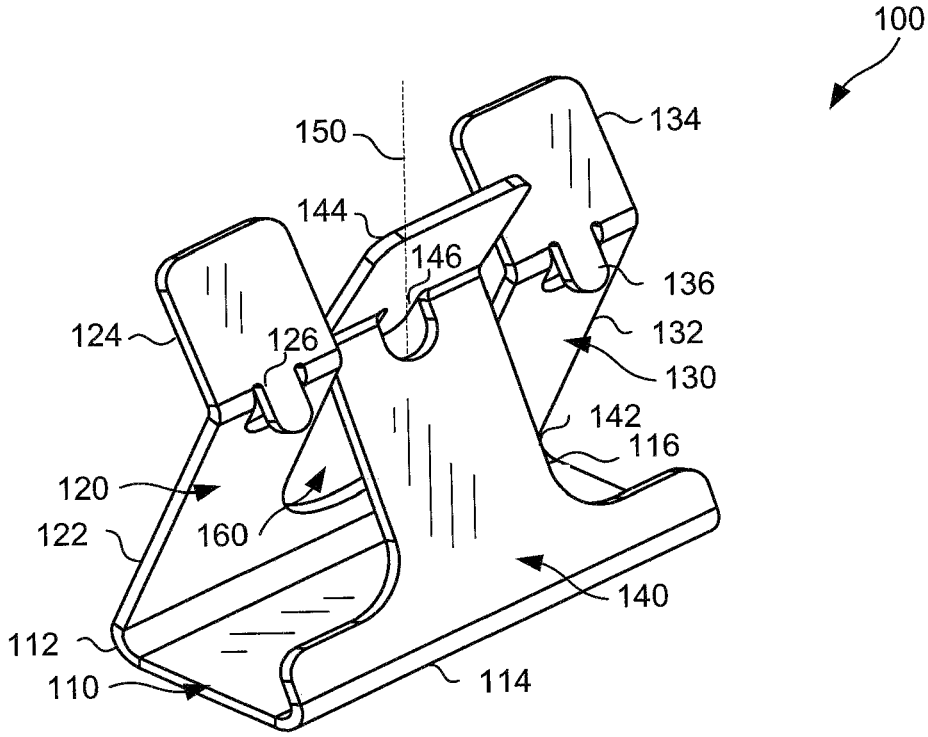
FIG. 1 illustrates an isometric view of an embodiment of a three-prong clip.

FIG. 1 illustrates an isometric view of an embodiment of a three-prong clip 100. In at least one embodiment, the three-prong clip 100 has a unitary body. For example, the three-prong clip 100 may be formed from a single sheet of stamped steel. The three-prong clip 100 includes a base 110, a pair of outer prongs 120 and 130, and a middle prong 140. Each of these components will be discussed in greater detail below.

The base 110 has a first side 112 and an opposing second side 114. The first side 112 and the second side 114 are orientated on opposing sides of a flat bottom 116 of the base 110. In at least one embodiment, the flat bottom 116 has a generally rectangular shape. A width of the flat bottom 116, i.e., the distance between the first side 112 and the second side 114 may be selected based on a thickness of one or more elements secured by the three-prong clip 100. For example, the three-prong clip 100 may secure a satellite antenna reflector and a reflector cover, and the distance between the first side 112 and the second side 114 may correlate with the combined thickness of the satellite antenna reflector and the reflector cover. An axis 150 extends orthogonally from the base 110 of the three-prong clip 100.

In at least one embodiment, the pair of outer prongs 120 and 130 are separated by a generally u-shaped opening 160. Each outer prong 120 and 130 includes a lower portion 122 and 132 extending upward from the base 110 towards the axis 150 at a first angle. The pair of outer prongs 120 and 130 each further include an upper portion 124 and 134 extending upward from the lower portion 122 and 132 away from the axis 150 at a second angle. In other words, each upper portion 124 and 134 extends from the axis 150 in a direction opposite its associated lower portion 122 and 132. The pair of outer prongs 120 and 130 each further include a retention tab 126 and 136 formed between the lower portion 122 and 132 and the upper portion 124 and 134 of each of the outer prongs 120 and 130.

The middle prong 140 is disposed within the u-shaped opening 160 between the pair of outer prongs 120 and 130. The middle prong 140 includes a first portion 142 extending upwards from the base towards the axis 150 at a first opposing angle. The middle prong 140 further includes a second portion 144 extending upward from the first portion 142 towards the axis 150 at a second opposing angle. Thus, the first portion 142 extends towards the axis in a different direction than the second portion 144. The middle prong 140 further includes a middle retention tab 146 formed in the first portion 142 and the second portion 144 at the second opposing angle.

The outer prongs 120 and 130 and the middle prong 140 are configured to separate and receive an element or elements therebetween. The prongs 120, 130 and 140 may form a tepee shape or a triangle. The retention tabs 126 and 136 on each outer prong 120 and 130 and the middle retention tab 146 on the middle prong 140 form a clamping surface on the element(s) secured therebetween. The three-prong clip 100 engages a surface of elements secured therebetween, pinching the elements(s) together to secure the elements(s) in place. The backwards facing retention tabs 126, 136 and 146 also act as an anti-removal feature, similar to a porcupine quill.

The three-prong clip 100 may be installed without the use of a tool. A user may separate the outer prongs 120 and 130 from the middle prong 140 by pulling the upper portions 124 and 134 in an opposite direction of the second portion 144. After the outer prongs 120 and 130 are separated from the middle prong 140, elements may be received between the outer prongs 120 and 130 and the middle prong 140. The outer prongs 120 and 130 and the middle prong 140 are then relaxed and move closer together, forming the clamping surface on the element(s) secured therebetween.

The three-prong clip 100 has strength and features that prevent elements secured by the prongs 120, 130 and 140 from slipping out of the three-prong clip 100. More specifically, the retention tabs 126, 136 and 146 engage the surface(s) of elements secured by the prongs 120, 130 and 140, preventing slipping of the elements. Two similar materials (e.g., plastic and steel) may be secured by the three-prong clip 100 without piercing either of the two surfaces of the element(s). The three-prong clip 100 does not rotate or twist towards one side in its installed state. If necessary, the three-prong clip 100 may be removed and reinstalled for multiple installations. Removal may be performed by pulling the upper portions 124 and 134 in an opposite direction of the second portion 144, and removing the element(s) secured by the prongs 120, 130 and 140.

Figure 2:
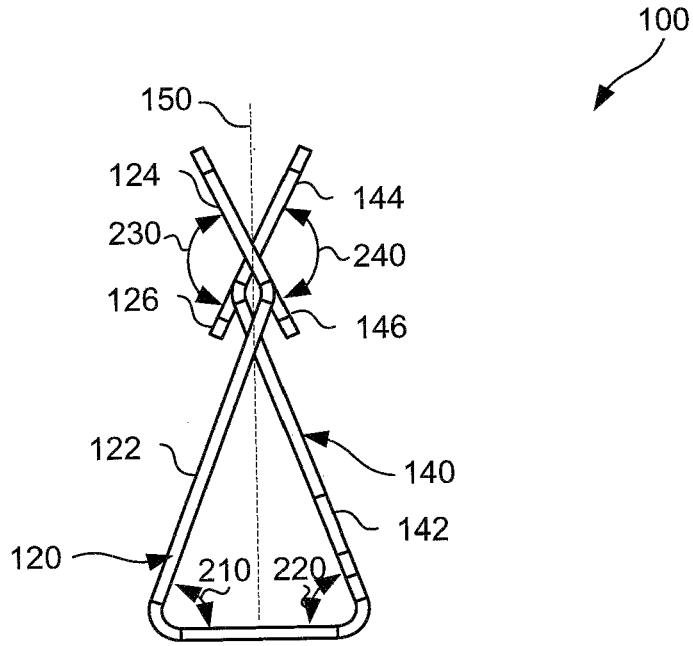
FIG. 2 illustrates a side view of an embodiment of the three-prong clip of FIG. 1.

FIG. 2 illustrates a side view of an embodiment of the three-prong clip 100 of FIG. 1. More particularly, FIG. 2 illustrates the relationship between the angles of the three-prong clip 100. In at least one embodiment, the lower portion 122 of the outer prong 120 extends upwards towards the first axis 150 at a first angle 210 of about 70°. Likewise, the lower portion 142 of the middle prong 140 extends upwards towards the axis 150 at a first opposing angle 220 that is substantially similar to the first angle 210 in an opposite direction of the axis 150. Thus, in at least one embodiment, the first opposing angle 220 extends upwards towards the first axis 150 at about 70°.

In at least one embodiment, the upper portion 124 extends upward from the lower portion 122 away from the axis 150 at a second angle 230 of about 135°. Similarly, the second portion 144 extends upward from the first portion 142 at a second opposing angle 240 that is substantially the same as the second angle (e.g., 135°). It is to be appreciated that the values of the first angle 210, the second angle 220, the first opposing angle 230 and the second opposing angle 240 may be specified based on desired design criteria. For example, the values of the angles 210-240 may be specified based on the material(s) to be secured by the three-prong clip 100 or by the forces expected to act on the material(s), e.g., wind forces. For example, the first angle 210 and the first opposing angle 220 may be between 60° and 80°. Likewise, the second angle 230 and the second opposing angle 240 may be between 125° and 145°. It is to be appreciated that larger angles may be utilized to accommodate the securing of thicker materials. The upper angles can be adjusted to increase or decrease the clamping force of the retention tabs. The prong lengths and other dimensions can also be adjusted per the particular design intent/usage.

Figure 3:
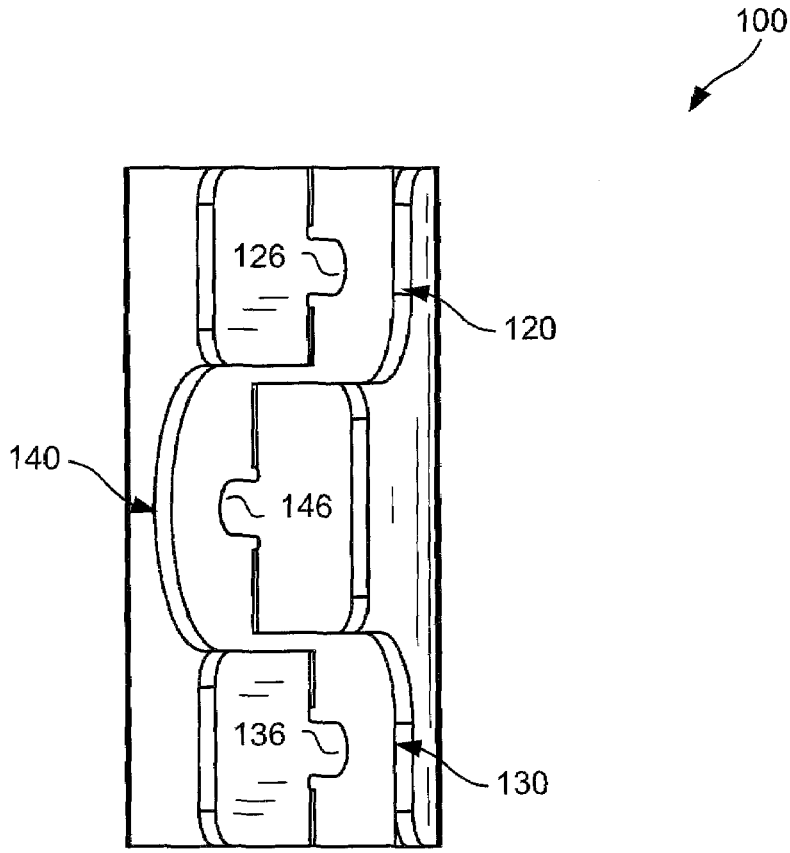
FIG. 3 illustrates a top view of an embodiment of the three-prong clip of FIG. 1.

FIG. 3 illustrates a top view of an embodiment of the three-prong clip 100 of FIG. 1. In a relaxed state with no material(s) secured therebetween, the prongs 120, 130 and 140 align as illustrated in FIG. 3. When installed, the three prongs 120, 130 and 140 separate to receive elements(s) therebetween. The middle prong 140 separates from the outer prongs 120 and 130 and moves towards the night side of FIG. 3. Similarly, the outer prongs 120 and 130 move towards the left side of FIG. 3. The interference fit yields a high clamping strength when installed, and the retention tabs 126, 136 and 146 engage the surface of material(s) therebetween to provide securing of the element(s), and prevent easy/unintentional removal.

Figure 4:
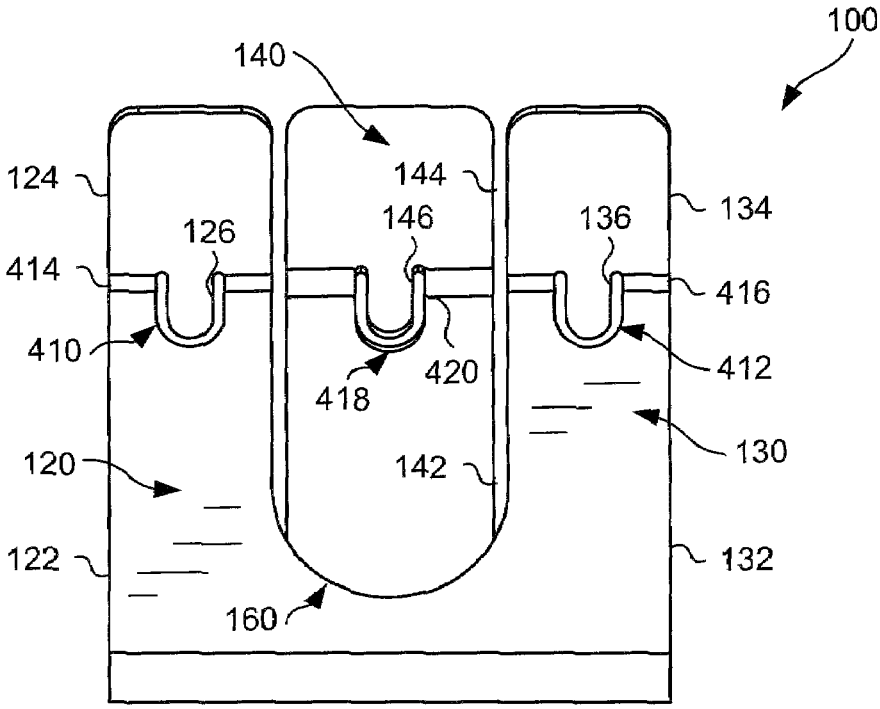
FIG. 4 illustrates an embodiment of a front view of the three-prong clip of FIG. 1.

FIG. 4 illustrates an embodiment of a front view of the three-prong clip 100 of FIG. 1. More particularly, FIG. 4 illustrates a front view from the perspective of the first side 112 of the base 110. As illustrated in FIG. 4, the retention tabs 126 and 136 include u-shaped cut-outs 410 and 412 formed at intersections 414 and 416 of the lower portions 122 and 132 and the upper portions 124 and 134. Likewise, the middle retention tab 146 includes a u-shaped cut out 418 formed at an intersection 420 of the first portion 142 and the second portion 144. The u-shaped cutout 418 is formed generally parallel to the u-shaped opening 160. The u-shaped cut-outs (410, 412, 418) allow for rapid manufacturing without compromising the strength of the retention tabs during the metal stamping process.

Figure 5:
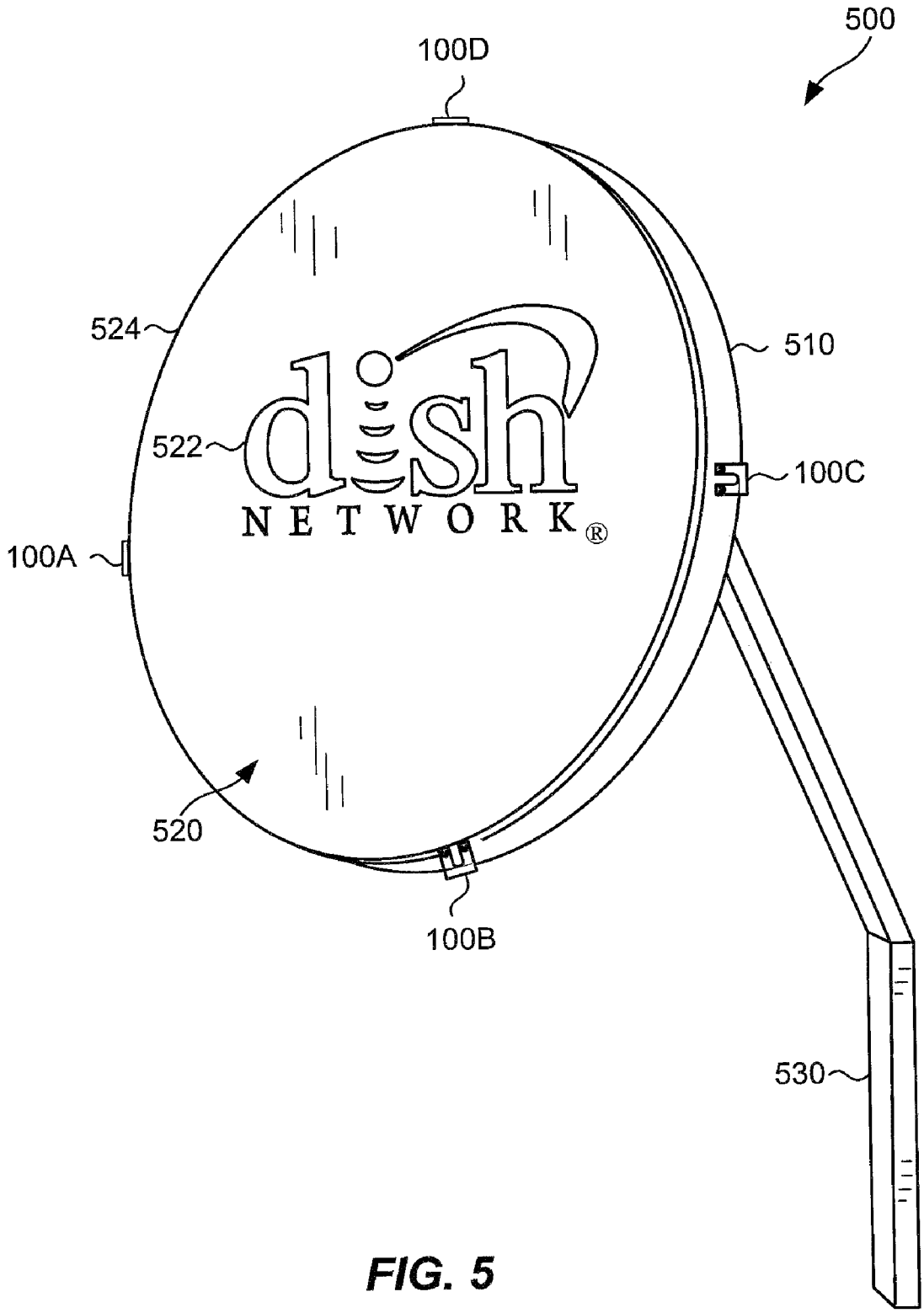
FIG. 5 illustrates an embodiment of an assembly of a satellite antenna.

The three-prong clip 100 may be utilized to secure a reflector cover to a satellite antenna reflector. FIG. 5 illustrates an embodiment of an assembly of a satellite antenna 500. The satellite antenna 500 includes a satellite antenna reflector 510, a reflector cover 520, a mounting arm 530 and a plurality of three-prong clips 100A-D. Each of the components will be discussed in greater detail below. It is to be appreciated that the material hardness may be adjusted in order to best comply with the design intent. In at least one embodiment, the clips 100A-D clasp the sides of the satellite reflector 510 along the rim and do not contact the front face of the satellite reflector 510. For example, the clips 100A-D may be replaced at the approximate "4 corners" of the reflector, or at approximately 1:30, 4:30, 7:30, and 10:30 o'clock when viewing the reflector head-on.

The satellite antenna reflector 510 is attached to the mounting arm 530. In at least one embodiment, the satellite antenna reflector 510 is made of metal (e.g., steel). The reflector cover 520 is molded to match the contours of the satellite antenna reflector 510. The reflector cover 520 may have an ornamental design 522 printed thereon, such as a cartoon character, sports team logo, company logo and the like. In at least one embodiment, the reflector cover 520 is made of plastic. The reflector cover 520 is attached to a front surface (not visible in FIG. 5) of the satellite antenna reflector 510.

A plurality of three prong clips 100A-D are installed on the satellite antenna 500. More specifically, as illustrated in FIG. 5, four three prong clips 100A-D are utilized to secure the reflector cover 520 to the satellite antenna reflector 510. It is to be appreciated that any number of three prong clips 100A-D may be used based on desired design criteria. Each three prong clip 100A-D is configured to attach and secure the reflector cover 520 to the satellite reflector antenna 510. In at least one embodiment, the clips 100A-D secure around the rim of the satellite reflector 510, thus not blocking the visible front face of the reflector surface. The retention tabs of each prong of the three-prong clips 100A-D form a clamping surface for the satellite antenna reflector generally parallel to the axis 150 (see FIG. 1) of the three-prong clips 100A-D.

In at least one embodiment, each three-prong clip 100A-D may be mounted such that the pair of outer prongs 120 and 130 (see FIG. 1) engage the rim of the reflector cover 520. In other words, the outer prongs 120 and 130 are mounted on a printed side of the reflector cover 520. Likewise, the middle prong 140 (see FIG. 1) of each of the three-prong clips 100A-D engages the back side (not visible in FIG. 5) of the satellite antenna reflector rim 510. This configuration provides the maximum clamping force on the reflector cover 520, which is not physically mounted to a structure like the satellite antenna reflector 510, without impeding on the satellite reflector's 510 display surface.

Figure 6:
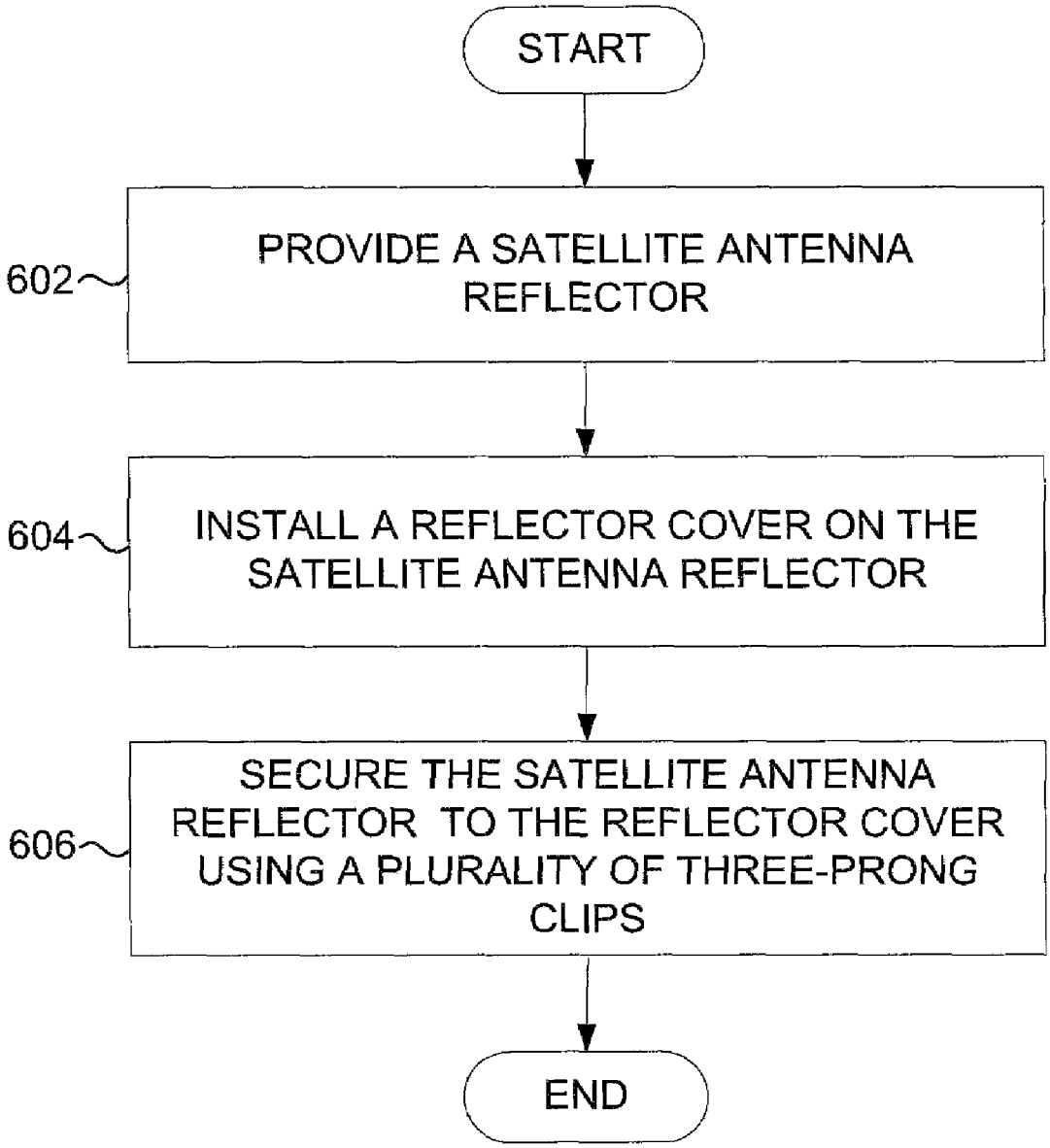
FIG. 6 illustrates a process of installing a reflector cover for a satellite antenna reflector.

FIG. 6 illustrates a process of installing a reflector cover for a satellite antenna reflector. More particularly, FIG. 6 illustrates a processor for installing a reflector cover to the satellite antenna reflector. The operations of the process of FIG. 6 are not all-inclusive, and may comprise other operations not illustrated for the sake of brevity.

The process includes providing a satellite antenna reflector (operation 602). The satellite antenna reflector may be provided as part of a satellite television installation. More specifically, operation 602 may include mounting a satellite antenna reflector (and its associated mounting arm) on a roof, wall, pole, balcony or fence of a structure. The process further includes installing a reflector cover on the satellite antenna reflector (operation 604).

The process further includes securing the reflector cover to the satellite antenna reflector with a plurality of three-prong unitary clips (operation 606). More specifically, the three prong clips each include a base having a first side, a second side, a flat bottom, with the axis extending orthogonally from the base. The three-prong clips each further include a pair of outer prongs on the first side separated by a generally u-shaped opening, each outer prong having a lower portion extending upward from the base towards the axis at a first angle, an upper portion extending upward from the lower portion away from the axis at a second angle, and a retention tab formed in the lower portion and the upper portion at the second angle. Each three-prong clip also includes a middle prong on the second side in the u-shaped opening having a first portion extending upward from the base towards the axis at a first opposing angle, a second portion extending upward from the first portion towards the axis at a second opposing angle, and a middle retention tab formed in the first portion and the second portion at the second opposing angle. The outer prongs and the middle prong separate and receive the reflector cover and the satellite antenna reflector therebetween, with the retention tab on each outer prong and the middle retention tab on the middle prong forming clamping surfaces on the satellite antenna reflector and the reflector cover. FIGS. 1-4 illustrate one embodiment of a three-prong clip utilized in operation 606.

Although specific embodiments were described herein, the scope of the invention is not limited to those specific embodiments. The scope of the invention is defined by the following claims and any equivalents therein.

What is claimed:

1. A three-prong clip comprising a base having a first side, a second side, a flat bottom and an axis extending orthogonally from the base;

a pair of outer prongs on the first side separated by a generally u-shaped opening, each outer prong having a lower portion extending upward from the base towards the axis at a first angle, an upper portion extending upward from the lower portion away from the axis at a second angle, and a retention tab formed in the upper portion and the upper portion at the second angle; and a middle prong on the second side in the u-shaped opening having a first portion extending upward from the base towards the axis at a first opposing angle, a second portion extending upward from the first portion towards the axis at a second opposing angle, and a middle retention tab formed in the first portion and the second portion at the second opposing angle;

the outer prongs and the middle prong configured to separate and receive an element therebetween with the retention tab on each outer prong and the middle retention tab on the middle prong forming a clamping surface.

2. The clip of claim 1, wherein the retention tab comprises a u-shaped cut out formed at an intersection of the lower portion and the upper portion.

3. The clip of claim 1, wherein the middle retention tab comprises a u-shaped cut out formed at an intersection of the first portion and the second portion generally parallel to the u-shaped opening separating the pair of outer prongs.

4. An assembly comprising:

a satellite antenna reflector;

a reflector cover attached to the satellite antenna reflector; and a three prong unitary clip on the satellite antenna reflector configured to attach the reflector cover and having a central axis, the clip comprising a base attached to the satellite reflector cover and three separate prongs formed on opposing sides of the base, each prong having a first portion extending from the base at a first angle towards the axis of the clip, a second portion extending from the first portion at a second angle away from the axis of the clip, and a retention tab comprising a cut out formed at an intersection of the first portion and the second portion;

the prongs configured to separate on the opposing sides of the base with each retention tab on each prong forming a clamping surface for the reflector generally parallel to the axis of the clip.

5. The assembly of claim 4, wherein the prongs include a pair of outer prongs separated by a generally u-shaped opening and a middle prong in the u-shaped opening.

6. The assembly of claim 4, wherein the prongs and the base form a triangle.

7. The assembly of claim 4, wherein the prongs and the base form a tepee shape.

8. The assembly of claim 4, wherein the first angle is between about 60° and about 80° and the second angle is between about 125° and about 145°.

9. A method of installing a reflector cover for a satellite antenna reflector, the method comprising:

providing a satellite antenna reflector;

installing a reflector cover on the satellite antenna reflector;

securing the reflector cover to the satellite antenna reflector with a plurality of three prong unitary clips on the satellite antenna reflector, the plurality of three prong clips each having a central axis and comprising:

a base having a first side, a second side and a flat bottom with the axis extending orthogonally from the base;

a pair of outer prongs on the first side separated by a generally u-shaped opening, each outer prong having a lower portion extending upward from the base towards the axis at a first angle, an upper portion extending upward from the lower portion away from the axis at a second angle, and a retention tab formed in the lower portion and the upper portion at the second angle; and a middle prong on the second side in the u-shaped opening having a first portion extending upward from the base towards the axis at a first opposing angle, a second portion extending upward from the first portion towards the axis at a second opposing angle, and a middle retention tab formed in the first portion and the second portion at the second opposing angle;

the outer prongs and the middle prong configured to separate and receive the reflector cover and the satellite antenna reflector therebetween with the retention tab on each outer prong and the middle retention tab on the middle prong forming a clamping surface.

10. The method of claim 9, wherein securing the reflector cover to the satellite antenna reflector further comprises:

mounting the clips such that the pair of outer prongs of each of the clips engage a first side of the reflector cover, and the middle prong of each of the clips engages a first side of the satellite antenna reflector.

11. The method of claim 9, wherein the retention tab comprises a unshaped cut out formed at an intersection of the lower portion and the upper portion.

12. The method of claim 9, wherein the middle retention tab comprises a u-shaped cut out formed at an intersection of the first portion and the second portion generally parallel to the u-shaped opening separating the pair of outer prongs.

13. The method of claim 9, wherein the prongs and the base form a triangle.

14. The method of claim 9, wherein the prongs and the base form a tepee shape.

15. The method of claim 9, wherein the first angle is between about 60° and about 80° and the second angle is between about 125° and about 145°.

* * * * *